US008960993B2

(12) United States Patent
Cheio De Oliveira et al.

(10) Patent No.: US 8,960,993 B2
(45) Date of Patent: Feb. 24, 2015

(54) BLENDER ASSEMBLY FOR PRODUCING A VACUUM INSIDE A VAT AND METHOD FOR DISPENSING PARTICLES THEREIN

(75) Inventors: Jose Cheio De Oliveira, Saint Hilaire de Loulay (FR); Henri Daheron, Bouffere (FR); Pascal Ricard, treize Septiers (FR)

(73) Assignee: VMI (FR)

( * ) Notice: Subject to any disclaimer, the term of this patent is extended or adjusted under 35 U.S.C. 154(b) by 1123 days.

(21) Appl. No.: 12/935,629

(22) PCT Filed: Feb. 11, 2009

(86) PCT No.: PCT/FR2009/000151

§ 371 (c)(1),
(2), (4) Date: Sep. 30, 2010

(87) PCT Pub. No.: WO2009/122021

PCT Pub. Date: Oct. 8, 2009

(65) Prior Publication Data

US 2011/0026358 A1 Feb. 3, 2011

(30) Foreign Application Priority Data

Mar. 31, 2008 (FR) ..... 08 01761

(51) Int. Cl.

| | |
|---|---|
| ***B01F 5/12*** | (2006.01) |
| ***B01F 13/06*** | (2006.01) |
| ***B01F 3/08*** | (2006.01) |
| ***B01F 3/12*** | (2006.01) |
| ***B01F 7/16*** | (2006.01) |
| ***B01F 15/02*** | (2006.01) |

(52) U.S. Cl.

CPC ..... *B01F 3/0807* (2013.01); *B01F 3/1221* (2013.01); *B01F 7/164* (2013.01); *B01F 15/0201* (2013.01); *B01F 15/0258* (2013.01); *B01F 2215/0014* (2013.01); *B01F 2215/0031* (2013.01); *B01F 2215/0032* (2013.01)

USPC ..... 366/139; 366/164.6; 366/264

(58) Field of Classification Search

CPC .. B01F 7/008; B01F 7/00808; B01F 7/00816; B01F 7/1625; B01F 7/163; B01F 7/1635; B01F 7/164; B01F 7/1645

USPC ..... 366/163.1, 164.1–164.6, 181.4, 264, 366/139, 182.4

See application file for complete search history.

(56) References Cited

U.S. PATENT DOCUMENTS

| | | | | |
|---|---|---|---|---|
| 1,496,641 | A * | 6/1924 | Hurrell | 241/146 |
| 7,178,977 | B2 * | 2/2007 | Colding-Kristensen et al. | 366/264 |

(Continued)

FOREIGN PATENT DOCUMENTS

| | | |
|---|---|---|
| CH | 271109 | 10/1950 |
| DE | 800977 U1 | 7/1980 |

(Continued)

OTHER PUBLICATIONS

International Search Report PCT/FR2009/000151; Dated Sep. 14, 2010.

*Primary Examiner* — Charles Cooley
(74) *Attorney, Agent, or Firm* — Cantor Colburn LLP

(57) ABSTRACT

A blender device including a rotor designed to engage with a motor device to be rotated; and an annular ring enclosing the rotor and having at least one axial orifice and a plurality of radial orifices for the passage of the blend. The blender also includes an admission duct for admitting particles intended to be incorporated into the blend, leading into the interior of the annular ring. The blender also effectively dispenses particles in a blend by introducing the particles with a high flow and decreasing product losses.

12 Claims, 4 Drawing Sheets

(56) References Cited

U.S. PATENT DOCUMENTS

| | | | | |
|---|---|---|---|---|
| 7,261,545 | B2 * | 8/2007 | Yerian et al. | 425/257 |
| 2004/0190373 | A1 * | 9/2004 | Colding-Kristensen et al. | 366/306 |
| 2004/0223407 | A1 * | 11/2004 | Gassenschmidt | 366/295 |
| 2011/0026358 | A1 * | 2/2011 | Cheio De Oliveira et al. | 366/139 |
| 2013/0315026 | A1 * | 11/2013 | Cheio De Oliveira et al. | 366/134 |

FOREIGN PATENT DOCUMENTS

| | | | |
|---|---|---|---|
| EP | 0801974 | A1 | 10/1997 |
| EP | 1155733 | A1 | 11/2001 |
| EP | 1338330 | A2 | 8/2003 |
| EP | 1475143 | A2 | 11/2004 |
| GB | 907063 | | 10/1962 |
| WO | 03002241 | A1 | 1/2003 |

* cited by examiner

BLENDER ASSEMBLY FOR PRODUCING A VACUUM INSIDE A VAT AND METHOD FOR DISPENSING PARTICLES THEREIN

TECHNICAL FIELD OF THE INVENTION

The invention concerns a blender device, a blender assembly equipped with such a device and a method for producing a preparation.

The device as well as the blender assembly are particularly intended for producing a preparation, and more particularly dispersing particles in a preparation.

BACKGROUND OF THE INVENTION

In the prior art, it is known to produce preparations by blending substances in a vat and introducing powdered particles into the vat in order to incorporate them in the blend.

Such preparations are commonly produced for pharmaceutical, cosmetic or agri-food industry applications. For pharmaceutical or cosmetic applications, the incorporated particles can in particular form the active ingredient of the composition and must then be incorporated into the blend in very precise proportions.

In order to produce these preparations, blender assemblies are known. According to the most widespread technology, these include a vat, kept in depression and intended to receive the blend, a rotor including blending blades and engaging with motor means in order to be rotated, and a stator including an annular ring surrounding the rotor and having radial orifices for the passage of the blend radially projected by said rotor.

Two methods are commonly used to incorporate the particles into the preparation.

According to a first method, illustrated in FIG. 1, the particles are introduced by suction into the vat kept in depression via an admission duct opening into the bottom of the vat, laterally to the rotor-stator unit. The admission duct is equipped with a gate making it possible to control the introduction of particles into the vat. The particles to be incorporated in the blend circulate in the vat approximately following the path of the arrows f1. However, in this case, the introduction flow of the powder is directly related to the level of vacuum in the vat. Also, for a given gate, it is necessary to increase the vacuum to increase the flow of particles introduced. However, depending on the viscosity of the blend in the vat, an excessively high vacuum level causes too fast a passage of the particles through the blend and the suctioned particles stick against the upper portion of the vat; this creates cleaning and loss-of-product problems.

According to a second method, illustrated in FIG. 2, the blender assembly is equipped with an outside hose allowing a recirculation of the preparation. In this embodiment, the powder particles are introduced into the vat via an admission duct opening into the outside hose. However, this method poses problems in terms of cleaning the outside recirculation hose. Furthermore, the introduction flow of the powder is limited by the dimensions of the outside hose and by the circulation flow therein.

BRIEF DESCRIPTION OF THE INVENTION

The invention aims to resolve these problems by proposing a blender device making it possible to effectively disperse particles in a blend, to introduce said particles with a high flow and to decrease product losses.

The device according to the invention can also be used in a blender assembly that is easy to clean.

To this end, and according to a first aspect, the invention proposes a blender device comprising:

- at least one rotor intended to cooperate with motor means in order to be rotated; and
- an annular ring surrounding the rotor and having at least one axial orifice and radial orifices for the passage of the blend; and
- an admission duct for admitting particles intended to be incorporated into the blend, opening inside said annular ring.

Thus, the particles of powder are dispersed effectively because the introduction of the particles is done directly in the turbulence zone.

Furthermore, the introduction of the powders can be more significant because it is possible to increase the vacuum level in a vat equipped with such a device without, however, the particles being projected against the upper portion of the vat.

Moreover, the blender assembly equipped with such a device does not require a hard-to-clean outside recirculation hose.

Lastly, the blender device according to the invention makes it possible to decrease the implementation time of the device to completely incorporate particles into the preparation.

Advantageously, the device includes an engine block including the rotor, the annular ring, motor means, and a shaft connecting the rotor to the motor means, and said engine block supports at least one portion of the admission duct.

Thus, the device is compact and easy to install on a blender assembly.

Advantageously, the admission duct is equipped with a gate supported by the engine block. The gate is preferably pneumatic flap gate.

In one embodiment, the engine block comprises means for fixing to a blender vat in order to facilitate the installation of the device on the vat of the blender assembly. The fixing means are pressure sealed in order to allow the depression of the blender vat equipped with such a blender device.

Advantageously, the admission duct passes through said means for fixing to a vat. Thus, the vat equipped with such a blender device only has a single passage for the installation of the rotor, the annular ring and the admission duct.

In one embodiment, the engine block includes two coaxial rotors. This embodiment makes it possible to further decrease the production time of the preparation.

In one preferred embodiment, the rotor(s) include(s) blender blades arranged to suction the blend through the axial orifice of the annular ring and project it radially through radial orifices of the annular ring.

Advantageously, the admission duct opens near the radial end of the blending blades of the rotor. Thus, the introduction of the particles in the vat is favored by the radial movement of the blend.

According to a second aspect, the invention concerns a blender assembly comprising a vat intended to receive a blend and a blender device according to the first aspect of the invention.

Advantageously, the blender assembly is equipped with means for creating a vacuum inside the vat. Thus, the particles coming from the admission duct are suctioned.

Lastly, according to a third aspect, the invention concerns a method for producing a preparation comprising:

- a blending step using:
  - a rotor rotated by motor means; and an annular ring surrounding the rotor and having at least one axial orifice and radial orifices for the passage of the blend;

a step for introducing particles into the vat via the inside of the annular ring in order to incorporate the particles into the blend.

Advantageously, the vat is kept in depression in order to allow the introduction of the particles by suction.

According to one embodiment, one blends at least two non-miscible substances in order to produce an emulsion.

BRIEF DESCRIPTION OF THE DRAWINGS

Other aims and advantages of the invention will appear during the following description, done in reference to the appended drawings, in which.

DETAILED DESCRIPTION OF THE INVENTION

Figure 1:
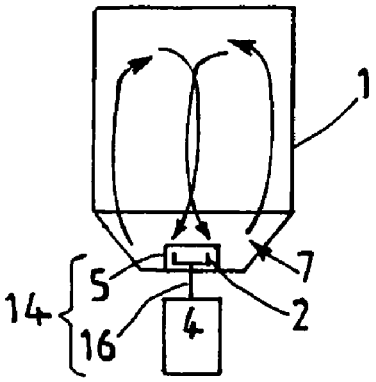
PRIOR ART FIG.1
FIGS. 1 and 2 are diagrammatic views illustrated blender assemblies for the production of an emulsion according to the prior art.
Figure 2:
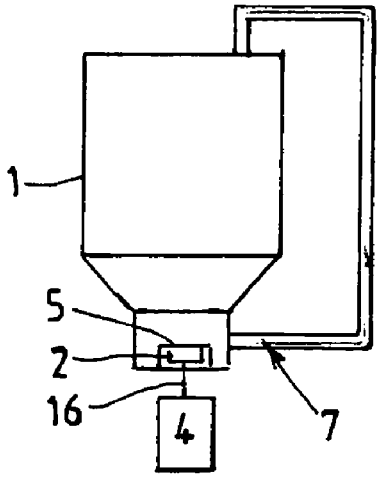
PRIOR ART FIG.2
Figure 3:
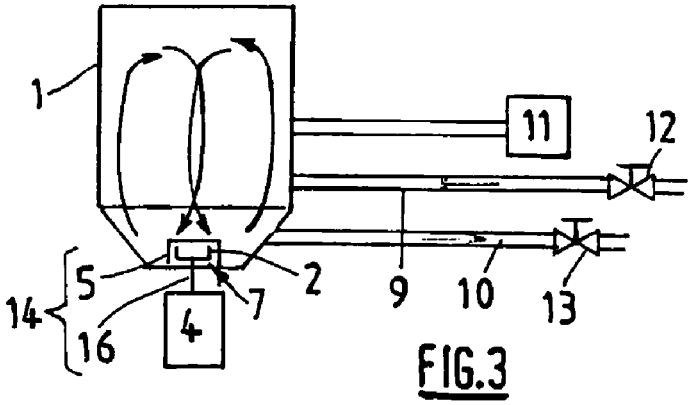
FIG. 3 is a diagrammatic view of a blender assembly according to the invention.
Figure 4:
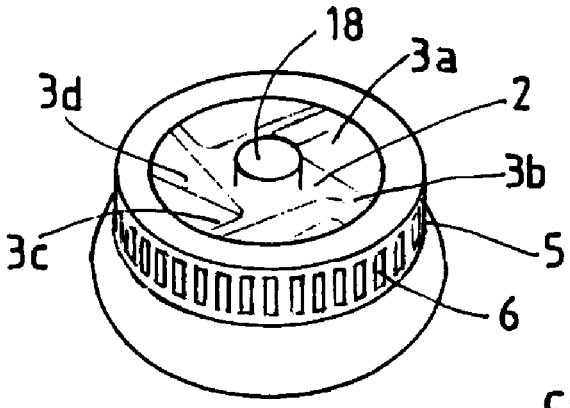
FIG. 4 is a diagrammatic view of a rotor and an annular ring.
Figure 5:
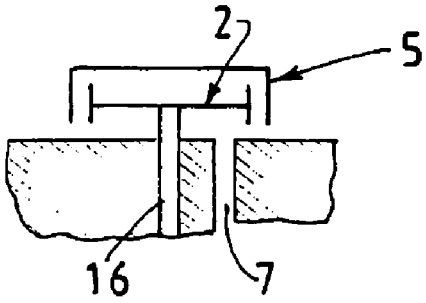
FIG. 5 is a diagrammatic radial cross-sectional view of a blender device.
Figure 6:
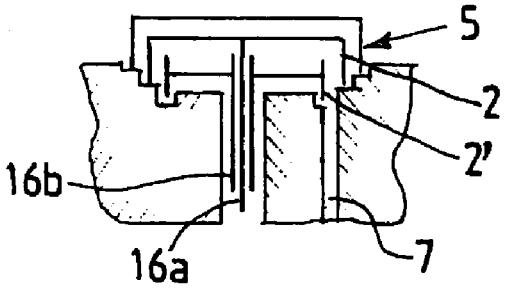
FIG. 6 is a diagrammatic radial cross-sectional view of a blender device comprising two rotors.

FIG. 3 diagrammatically illustrates a blender assembly, according to the invention. This assembly comprises a vat 1, a blender device 14, admission means 9 and evacuation means 10 for fluids.

At least two fluids intended to be blended in the vat 1 are conveyed by the admission means 9, pass through the vat 1 and are evacuated by the evacuation means 10. The admission means 9 and evacuation means 10 each include a line for passage of the fluids and a gate 12, 13 making it possible to regulate the admission and evacuation flow.

The blender assembly is also equipped with means, such as a pump 11, making it possible to form a vacuum inside the vat 1. In operation, the depression reigning inside the vat can extend between 0 and 0.99 bar.

The blender device according to the invention includes a rotor 2 that rotates inside an annular ring 5.

The rotor 2 engages with motor means 4 in order to be rotated and includes blending blades 3*a*, 3*b*, 3*c*, 3*d* arranged to axially suction the blend and project it radially through the rotor 2. The rotor 2 is connected to the motor means 4 by a shaft 16 and includes, to that end, a cylindrical bore 17 (see FIGS. 7 and 8) making it possible to connect the end of the shaft 16 to the rotor 2.

The blender device also includes an annular ring 5 surrounding the rotor 2. The annular ring 5 can be fixed, and will in this case be called rotor, or rotatably mobile (not shown). The ring 5 has an upper axial orifice 18 allowing the passage of the blend suctioned by the rotor 2. The annular ring 5 also includes, on its periphery, orifices 6 for the passage of the blend projected radially by said rotor 2. The radial orifices 6 are slits parallel to each other and are separated by portions serving as impact surface. The blend projected by the rotor 2, through the openings 6, depending on the radial direction undergo a shearing depending on said radial direction. Moreover, the space between the rotor 2 and the annular ring 5 is small enough to obtain the desired shearing stresses.

Figure 7:
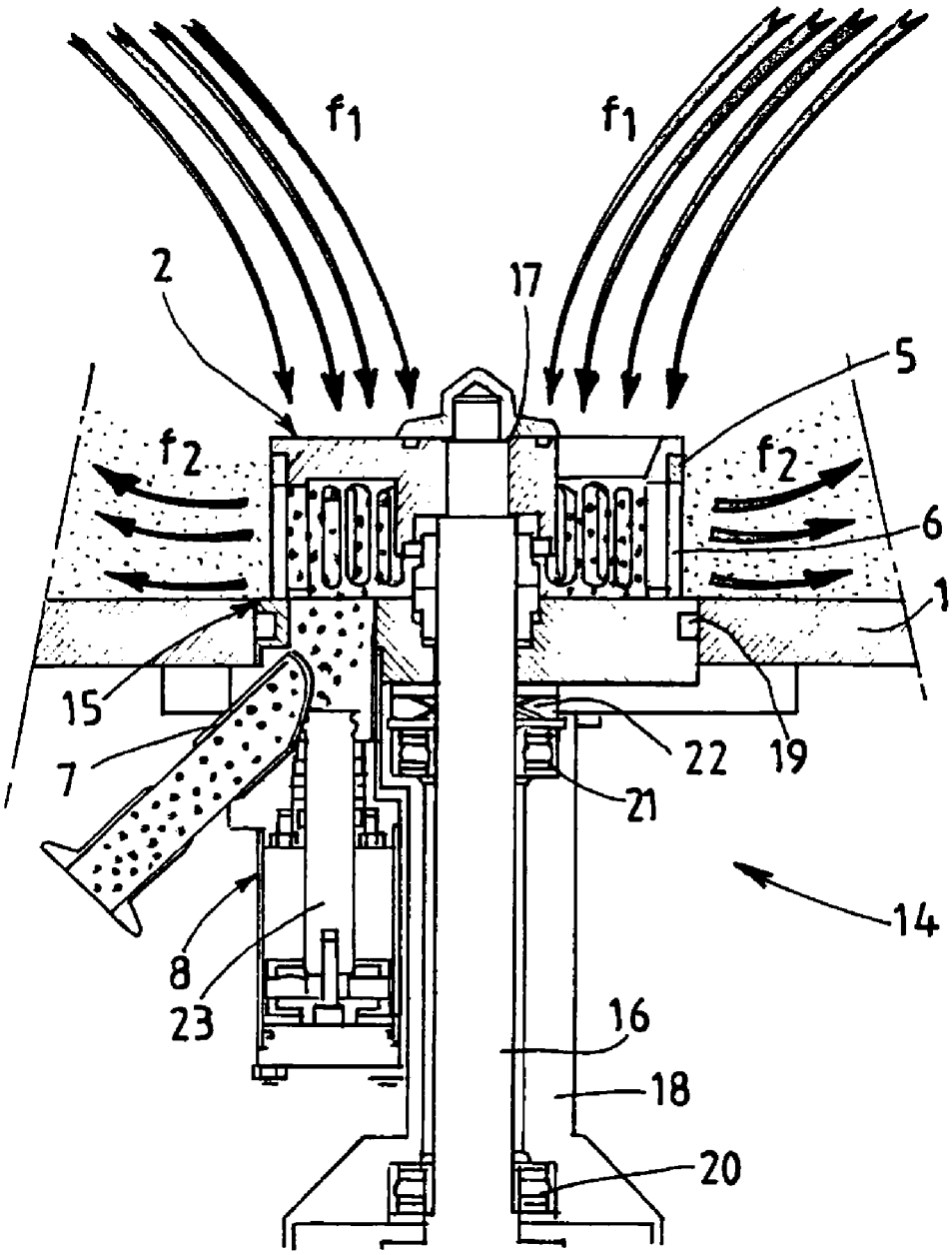
FIG. 7 is a diagrammatic cross-sectional view of a blender device, according to a first embodiment of the invention, in operation; the arrows show the movement of the blend inside the vat.

According to the arrows of FIG. 7, illustrating the movement of the blend in the vat 1, when the rotor 2 is rotated, the blend is suctioned in the axial direction along the arrows f1 and projected outwardly through radial slits, following the arrows f2. The blend is thus forced to flow through the slits of the ring 5. Advantageously, the blender assembly can comprise one or several turbines, not shown, arranged inside the vat 1 and arranged to drive the blend, along the direction of the arrows f2, toward the axis of the rotor 2.

Figure 8:
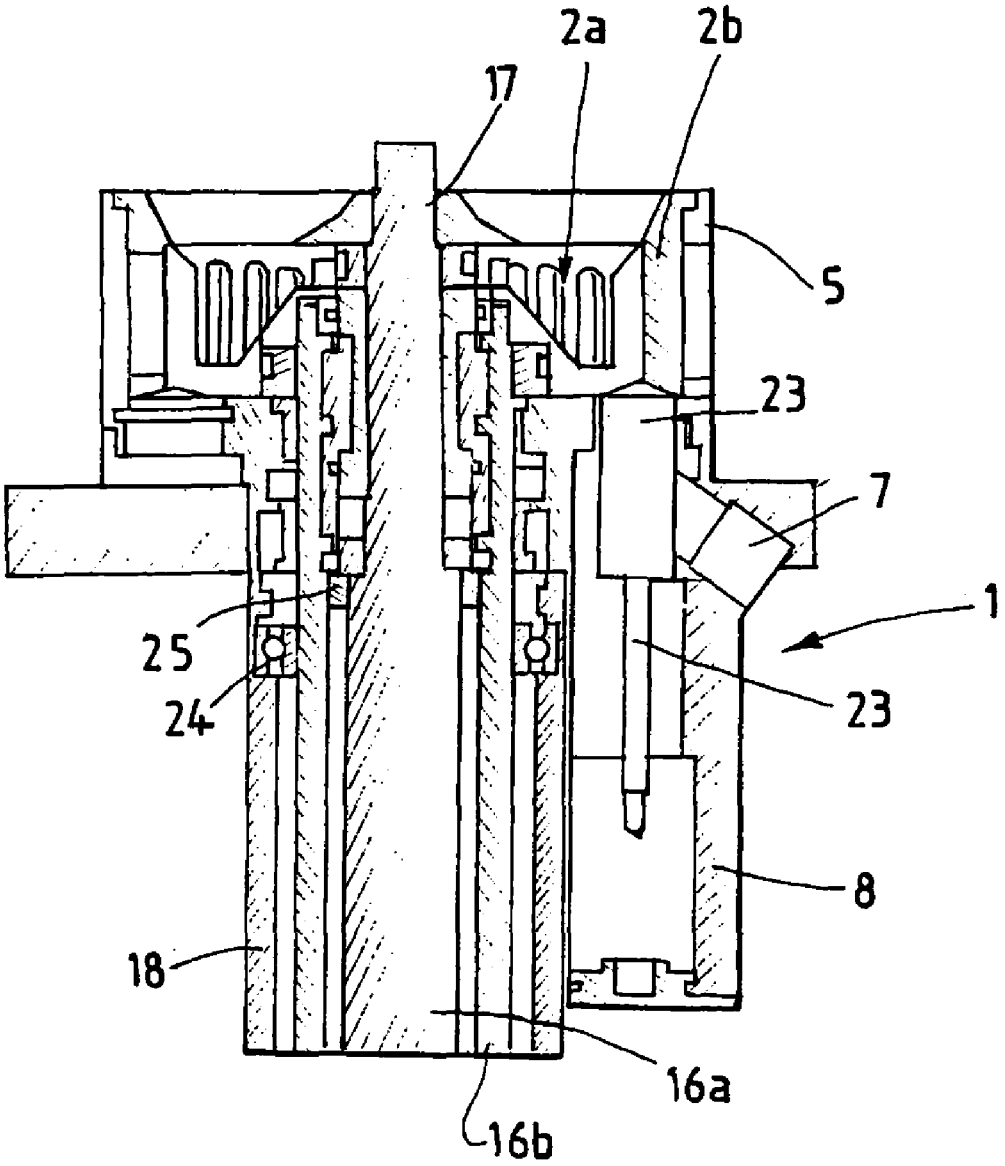
FIG. 8 is a diagrammatic view of a blender device according to a second embodiment of the invention.

In the embodiment shown in FIGS. 7 and 8, the blender device is realized in the form of an engine block, comprising the motor means 4, the shaft 16, the rotor 2, the annular ring 5 and a casing 18 making it possible to house the shaft 16.

The device includes an admission duct 7 for admitting particles in the vat 1. According to the invention, in order to disperse the particles effectively in the blend, the admission duct 7 opens directly inside the annular ring 5. The other end of the admission duct 7 is intended to be submerged in a particle reservoir so as to ensure the suction of the particles. The introduction of the particles inside the vat 1 is ensured by the depression reigning inside the vat 1 and a gate 8 equipping the admission duct 7 makes it possible to regulate the introduction flow of particles in the vat 1. Advantageously, the admission duct 7 opens near the radial end of the blades 3*a*, 3*b*, 3*c*, 3*d*. Thus, the introduction of the particles is encouraged by the radial projection of the blend during the rotation of the rotor 2.

In the illustrated embodiments, the gate 8 is fixed directly to the casing 18 of the engine block. The gate 8 used is for example a pneumatic flap gate 23.

In the embodiment detailed in FIG. 7, the annular ring 5 is supported by a circular plate 15. This plate 15 is intended to be inserted into a central cavity of the vat 1. In order to ensure sealing, the side wall of the plate 15 is equipped with a circular groove 19 and an O-ring housed in said circular groove 19. The ring makes it possible to ensure the sealing of the vat against liquid and pressure.

In order to allow the transmission of the rotational movement of the motor means 4 toward the rotor 2, the shaft 16 passes through a central bore formed in the plate 15 and is guided in rotation by guide bearings 20, 21 supported by the casing 18. Moreover, the casing 18 supports an O-ring 22 making it possible to seal the central bore of the plate 15 against gas and liquids.

Moreover, the plate 15 includes an admission orifice for admitting the particles that is connected to the admission duct 7 of the particles. In the closed position, the valve 23 of the gate 8 closes the passage between the admission duct and the admission orifice, whereas in the open position, illustrated in FIG. 7, the valve 23 of the gate 8 frees the space for the passage of the particles. In one advantageously embodiment of the invention, the gate 8 can be equipped with sensors making it possible to detect the position of the valve 23.

The engine block also includes means for sealed fixing to the vat 1, not shown, arranged between the rotor 2 and the admission duct 7. To that end, the plate 15 is for example made integral with the vat 1 by welding, or using screws inserted through orifices formed in the plate 15 and engaging with orifices formed in the vat 1.

The admission duct 7 passes through the fixing means. Thus, the vat 1 only includes a single opening for the passage of the admission duct 7 of the rotor 2 and the annular ring 5.

FIG. 8 illustrates a blender device according to a second embodiment, comprising two coaxial rotors 2*a*, 2*b* intended to rotate in opposite directions.

To that end, the engine block includes an outer shaft 16*b* rotatably mounted on the casing 18 using bearings 24 and engaging with the outer rotor 2*b*, and an inner shaft 16*a* coaxial to the outer shaft 16*b*, guided in rotation on the outer shaft 16*b* using bearings 25 and cooperating with the central rotor 2*a*. The two shafts 16*a*, 16*b* cooperate with motor means 4 so as to be driven in the opposite direction. The rotational speed of the shafts 16*a*, 16*b* is in the vicinity of 3000 rpm.

According to the invention, in order to produce the preparation, one introduces at least two substances into the vat via the admission means 9 and drives the rotors 2, 2*a*, 2*b* of the blender device. The vat 1 is kept in depression by the pump 11.

The gate 8 is subsequently displaced in the open position, such that the particles coming from the admission duct 7 are suctioned via the inside of the annular ring of the stator 5, inside the vat 1. The gate 8 is then displaced toward its closed position when the desired quantity of particles has been introduced.

When the particles have been integrated into the preparation, the latter is evacuated via the evacuation means 10.

In one specific embodiment, one blends two non-miscible substances in order to obtain an emulsion.

The invention is described above as an example. It is understood that a person skilled in the art can produce different alternative embodiments of the invention without going beyond the scope of the invention.

In particular, one may notably provide for forming the admission duct 7 for admitting particles inside the motor shaft 16.

The invention claimed is:

1. A blender assembly, comprising:

a vat, a pump configured for producing a vacuum inside said vat, and a blender device comprising:

at least one rotor disposed inside said vat and intended to cooperate with motor means in order to be rotated; and an annular ring disposed inside said vat and surrounding the rotor and having at least one axial orifice and radial orifices for the passage of the blend;

an admission duct for admitting particles intended to be incorporated into the blend, opening inside said annular ring and on a side opposite said annular ring.

2. The assembly according to claim 1, wherein said blender device comprises an engine block including the motor means and a shaft connecting the rotor to the motor means.

3. The assembly according to claim 2, wherein the engine block supports at least one portion of the admission duct.

4. The assembly according to claim 2, wherein the admission duct is equipped with a gate supported by the engine block.

5. The assembly according to claim 4, wherein the gate is a flap gate.

6. The assembly according to claim 4, wherein the gate is a pneumatic gate.

7. The assembly according to claim 2, wherein the engine block includes the rotor and the annular ring.

8. The assembly according to claim 2, wherein the engine block includes two coaxial rotors.

9. The assembly according to claim 1, wherein the rotor includes blending blades arranged to suction the blend through the axial orifice of the annular ring and project it radially through radial orifices of the annular ring.

10. The assembly according to claim 9, wherein the admission duct opens near a radial end of the blender blades of the rotor.

11. A method for producing a preparation including the following steps:

providing a blender assembly having a vat, a pump configured for producing a vacuum inside the vat, and a blender wherein the blender includes at least one rotor intended to cooperate with motor means to be rotated; and an annular ring surrounding the rotor and having at least one axial orifice and radial orifices for the passage of the blend;

providing an admission duct for admitting particles to be incorporated into the blend, opening inside the annular ring;

blending a plurality of particles;

introducing the plurality of particles by suction into the vat kept in depression, via the inside of the annular ring in order to incorporate the plurality of particles into the blend.

12. The method according to claim 11, further including the step of blending at least two non-miscible substances to produce an emulsion.

* * * * *